US005772195A

United States Patent [19]

Mueller

[11] Patent Number: 5,772,195

[45] Date of Patent: Jun. 30, 1998

[54] GATHERING AND WIRE STITCHING MACHINE WITH MULTIPLE WIRE STITCHING STATIONS

[75] Inventor: Hans Mueller, Zofingen, Switzerland

[73] Assignee: GRAPHA-Holding AG, Hergiswil, Switzerland

[21] Appl. No.: 708,952

[22] Filed: Sep. 6, 1996

[30] Foreign Application Priority Data

Sep. 8, 1995 [CH] Switzerland ..... 02 552/95

[51] Int. Cl.[6] ..... B65H 39/00

[52] U.S. Cl. ..... 270/52.16; 270/52.29

[58] Field of Search ..... 270/52.14, 52.16, 270/52.26, 52.29

[56] References Cited

U.S. PATENT DOCUMENTS

| | | | |
|---|---|---|---|
| 2,699,749 | 1/1955 | Halley . | |
| 3,032,336 | 5/1962 | Heigl et al. | 270/52.29 X |
| 3,510,119 | 5/1970 | Linden | 270/52.29 |
| 4,519,599 | 5/1985 | Mayer | 270/52.29 X |
| 4,564,186 | 1/1986 | Clark, Jr. et al. | 270/52.29 |

FOREIGN PATENT DOCUMENTS

| | | |
|---|---|---|
| 3616566A1 | 12/1986 | Germany . |
| 3616566C2 | 7/1991 | Germany . |
| 337177 | 5/1959 | Switzerland . |
| 664113A5 | 2/1988 | Switzerland . |

*Primary Examiner*—Hoang Nguyen
*Attorney, Agent, or Firm*—Spencer & Frank

[57] ABSTRACT

A gathering and wire stitching machine for producing magazines, booklets and similar products from folded printed sheets comprises a conveyor path including a gathering segment and an adjoining wire stitching segment. The conveyor path including a saddle-shaped support for receiving printed sheets in a straddling arrangement from feeders arranged along the gathering segment. The gathering segment includes continuously conveying drive devices along the support for moving the printed products in a transport direction and which operate jointly and in cycle with the feeders to convey the deposited printed sheets at regular intervals to the adjoining wire stitching segment. The wire stitching segment includes a first wire stitching station having a first wire stitching device and a second wire stitching station spaced apart from the first wire stitching station along the conveyor path and having a second wire stitching device connected for being driven in cycle with the first wire stitching device.

8 Claims, 2 Drawing Sheets

GATHERING AND WIRE STITCHING MACHINE WITH MULTIPLE WIRE STITCHING STATIONS

BACKGROUND OF THE INVENTION

The invention relates to a gathering and wire stitching machine for producing magazines, booklets and similar products from folded printed sheets, consisting of a conveyor path having a saddle-shaped support along which feeders are arranged that form a gathering segment for a straddled feeding of the gathering segment with printed sheets, wherein the gathering segment has conveying means attached along the support, which operate jointly in cycle with the feeders, to continuously convey the deposited printed sheets at regular intervals to a stitching segment that adjoins the gathering segment of the conveyor path, and wherein the stitching segment is designed as a wire stitching device of a wire stitching station that penetrates the folded edge of the printed products, consisting of gathered printed sheets, with wire stitches.

Among the gathering and wire stitching machines of the above-described type, there are those, for which the printed sheets on a conveyor path are stopped briefly during the stitching operation and others, where the printed sheets that are to be stitched are joined at the back fold by a stitching slide that travels along during one stitching interval as disclosed, for example, in Swiss Patent publication 337 177. The latter reach a production capacity of approximately 18,000 copies per hour and thus hit a mechanical stress limit for the gathering and wire stitching machine.

German patent publication No. 36 16 566, discloses a gathering and wire stitching machine having several conveyor paths arranged along the circumference of a rotating drum, on which the printed sheets are gathered on a gathering segment of the conveyor path and are transported to an adjoining wire stitching segment. The wire stitching takes place while the drum is rotating and the folded printed sheets remain stationary on the conveyor paths.

Gathering and wire stitching machines of this type have twice the production capacity as compared to the above-described conventional gathering and wire stitching machines. With respect to construction, they are several times more expensive and their use is economical only if high numbers of copies are produced. On the other hand, this means that smaller printing orders prove to be unprofitable, or that the high operating costs would increase the selling price for the printed products to an unreasonable amount.

SUMMARY OF THE INVENTION

It is an object of the invention to provide a gathering and wire stitching machine of the aforementioned type, which can be used to produce printed products in a more economical way by taking into account the adjustment times and the order sizes.

The above and other objects are accomplished in accordance with the invention by the provision of a gathering and wire stitching machine for producing magazines, booklets and similar products from folded printed sheets, comprising: a conveyor path including a gathering segment and an adjoining wire stitching segment, the conveyor path including a saddle-shaped support for receiving printed sheets in a straddling arrangement from feeders arranged along the gathering segment, the gathering segment including continuously conveying drive devices along the support for moving the printed products in a transport direction and operating jointly and in cycle with the feeders to convey the deposited printed sheets at regular intervals to the adjoining wire stitching segment, the wire stitching segment including a first wire stitching station having a first wire stitching device and a second wire stitching station spaced apart from the first wire stitching station along the conveyor path and having a second wire stitching device connected for being driven in cycle with the first wire stitching device.

The invention thus has the advantage that it is possible to initially achieve a corresponding reduction in the rotating movement leading to the oscillation movement of the wire stitching device, for example, by doubling the radius of action for a crank gear used as a drive, as compared to the radius of action previously used for the crank, and in a reduction of the centrifugal forces, generated until then with the rotating movement, without productivity losses for the gathering and wire stitching machine. There is additionally the possibility of increasing the productivity of a gathering and wire stitching machine by increasing the speed of the rotational movement or the oscillating movement of the wire stitching device along the stitching segment.

The invention is explained in greater detail below with the aid of the accompanying drawings.

DETAILED DESCRIPTION OF THE PREFERRED EMBODIMENTS

Figure 1:
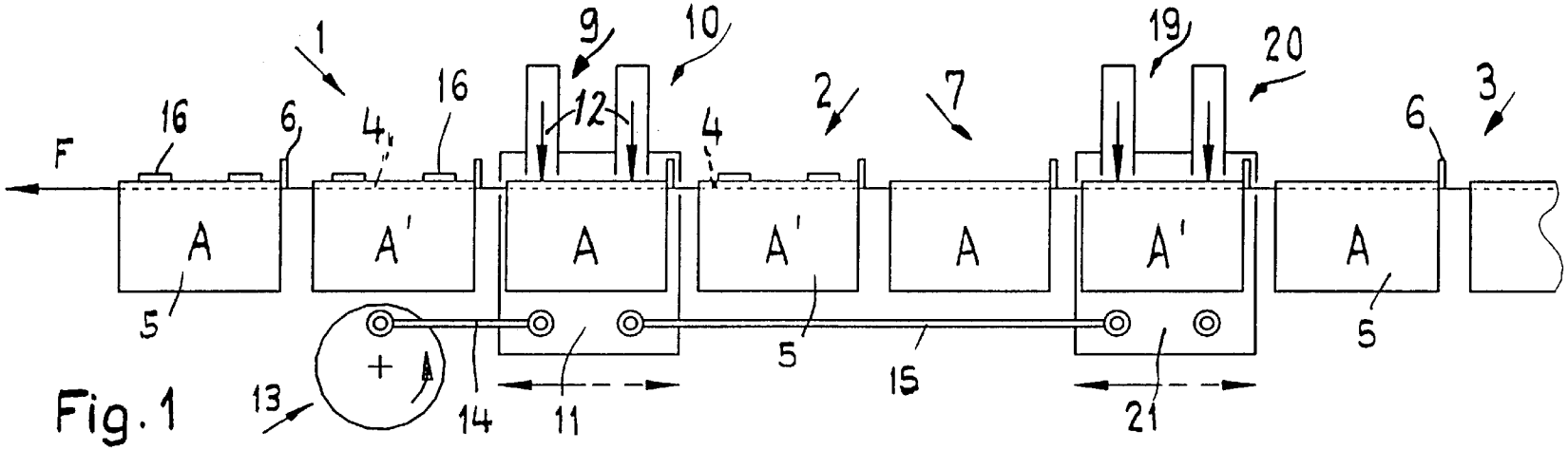
FIG. 1 is a schematic showing an elevational view of a gathering and wire stitching machine with two wire stitching stations arranged on a conveyor path according to the principles of the invention.

FIG. 1 illustrates a conveyor path 2 of a gathering and wire stitching machine 1 at the end of a gathering segment 3 with an adjoining stitching segment 7. Conveyor path 2 is designed as a saddle-shaped support, onto which the feeders (not shown), installed side-by-side in a conveying direction F, deposit printed sheets in the area of gathering segment 3, such that they are straddled one above the other and are transported by a conveyor 4 with drive means or carriers 6 to wire stitching segment 7 that adjoins gathering segment 3. Conveyor 4, which is effective along conveyor path 2, consists of an endlessly circulating traction roller, to which carriers 6 are attached at regular intervals. Printed products 5, formed by folded printed sheets, are deposited one above the other such that they straddle gathering segment 3, are gripped by carriers 6 that abut the rear edge of printed products 5 and transported to stitching segment 7 for wire stitching. The stitching as well as the gathering of printed sheets takes place with conveyor 4 operating continuously, meaning that during the wire stitching operation in wire stitching segment 7, a wire stitching device 9 of a stationary wire stitching station 10 follows the printed products 5 with the same or nearly the same speed.

Wire stitching device 9 is for this purpose attached to a wire stitching slide 11, which is guided along wire stitching segment 7 and has an oscillating drive.

As can be seen in FIG. 1, wire stitching device 9, formed in this case by two wire stitching heads 12, is operated by a crank gear 13, which is connected via a guide rod 14 with a stitching slide 11. In the position shown for crank gear 13, stitching slide 11 moves at the highest speed, which corresponds to the conveying speed for printed products 5 on conveyor path 2. Subsequently, stitching slide 11 experiences a delay, caused by a constant change in the crank position, which ends at one terminal position for stitching slide 11 which is the start of a further acceleration. With this acceleration, which changes to a delay, stitching slide 11 is on the return route to its initial position where the wire stitching cycle or the wire stitching movement of wire stitching slide 11 is initiated by a renewed acceleration to the conveying speed of printed products 5.

As shown in FIG. 1, another wire stitching station 20 is arranged along stitching segment 7 of conveyor path 2, for which a wire stitching device 19 is connected to wire stitching device 9 of wire stitching station 10 via a corresponding stitching slide 21 and a connecting device or rod 15. The stitching capacity of the individual wire stitching devices 9, 19 of wire stitching stations 10, 20, respectively, is thus reduced in a wear saving manner, without having to detract from the overall capacity of gathering and wire stitching machine 1, meaning that each wire stitching device 9, 19 now stitches each second printed product 5.

More specifically, the printed products 5 labeled A are allocated exclusively to wire stitching device 9 at wire stitching station 10 and those labeled with A' are now allocated to wire stitching device 19 of wire stitching station 20. With this arrangement, the wire stitching preparations, taking place in wire stitching devices 9, 19, and the wire stitching itself (=wire stitching cycle) can take place over a longer time period than previously. Consequently, stress on the machine parts in question and wear manifestations at the wire stitching devices are moderated considerably. In general, if there are n stitching stations, each stitching station can be driven at 1/n cycles of the conveyor movement of the printed products along the conveyor path.

Stitched printed products 5 that have been operated on by one or the other of the stitching devices 9, 19 are penetrated by wire stitches 16.

The use of two stitching devices as shown in FIG. 1 also permits the use of two coupled crank gears, where each one acts upon a respective wire stitching device 9, 19, instead of the combination mechanism utilizing connecting rod 15.

Figure 2:
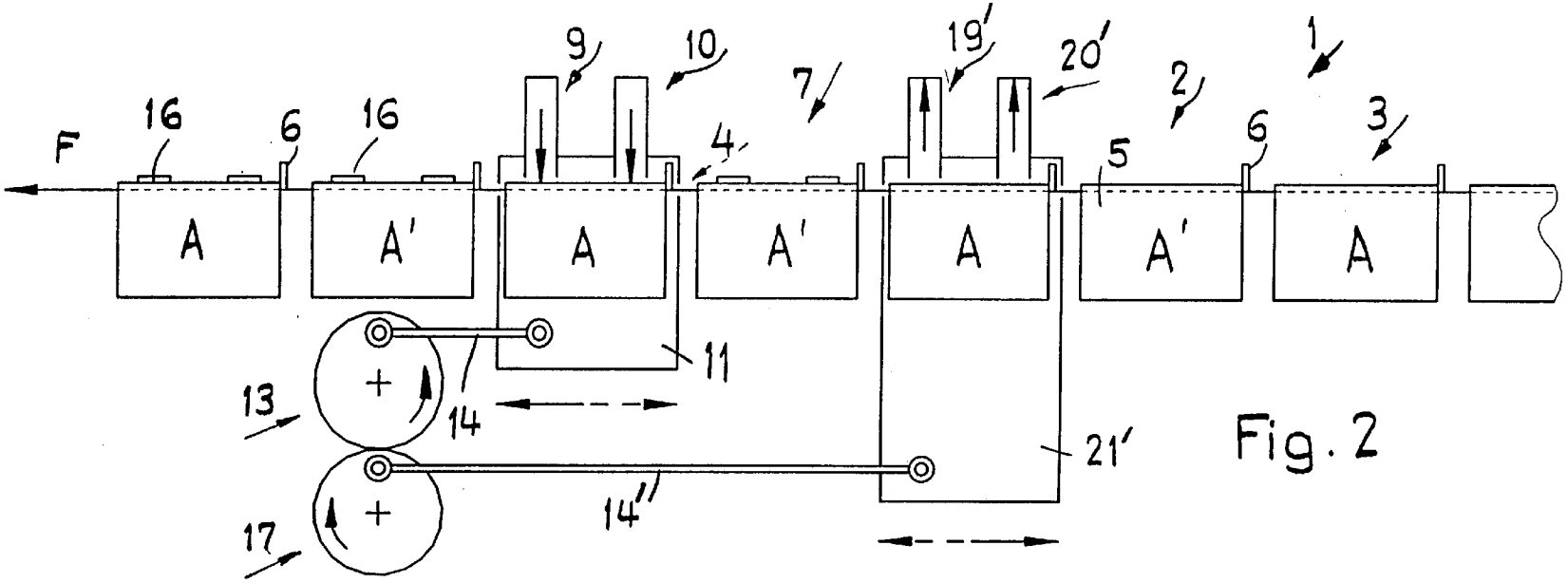
FIG. 2 is a schematic showing a similar view as FIG. 1 of an alternative embodiment of the invention.

FIG. 2 shows an embodiment of a gathering and wire stitching device 1 similar to FIG. 1, which permits a further, considerably improved embodiment, based on the principle of several wire stitching stations along one conveyor path. In contrast to FIG. 1, FIG. 2 shows two wire stitching devices 9, 19' for two wire stitching stations 10, 20', respectively, which are arranged along wire stitching segment 7, and have an opposite oscillating movement with respect to the movement along conveyor path 2 and an alternating drive with respect to the wire stitching. That is, one wire stitching device 9 performs a wire stitching lifting motion while the other wire stitching device 19' is on the way back to the initial position, so that there is a balance of the moving masses of the wire stitching devices. This process is depicted by the arrow positions corresponding with wire stitching slides 11, 21' and wire stitching devices 9, 19'. While wire stitching device 9 performs the wire stitching operation on printed product A, wire stitching device 19' moves against the conveying direction F toward the starting position, to revert subsequently to the same movement direction as the printed product A', which has arrived underneath it. According to FIG. 2, a crank gear arrangement is utilized that consists of two equal crank gears 13, 17 that are connected in each case via respective guide rods 14, 14' with a corresponding wire stitching slide 11, 21' of wire stitching stations 10, 20', respectively. Wire stitching stations 10 and 20' in FIG. 2 are separated by one feed hole space (i.e., the space occupied by a printed product on the conveyor path), whereas stitching station 10 and 20 in FIG. 1 are separated by two feed hole spaces.

Figure 3:
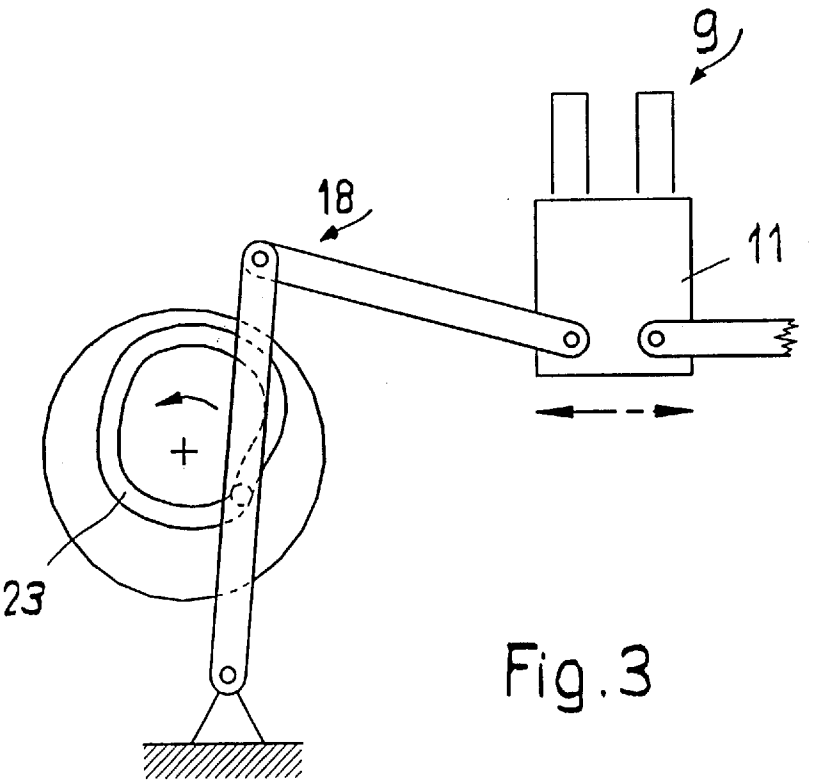
FIG. 3 is a schematic showing a portion of a drive mechanism for the wire stitching device of a wire stitching station that could be used in the embodiments shown in FIGS. 1 and 2.

FIG. 3 shows a variation for a drive mechanism, in place of the crank gears shown in FIGS. 1 and 2, for driving the stitching slides. A lever gear 18, connected, for example to wire stitching slide 11 for front wire stitching device 9 represented in FIG. 1, is moved by a rotationally driven, endless control path 23.

For an embodiment as illustrated in FIG. 2, two control paths 23 with a phase-displaced drive would be required to drive the wire stitching devices 9, 19' along conveyor path 2 with a counter-rotating oscillating movement.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. A gathering and wire stitching machine for producing products from folded printed sheets, comprising:

a conveyor path including a gathering segment and an adjoining wire stitching segment, the conveyor path including a saddle-shaped support for receiving printed sheets in a straddling arrangement from feeders arranged along the gathering segment, the gathering segment including continuously conveying drive devices along the support for moving the printed products in a transport direction and operating jointly and in cycle with the feeders to convey the deposited printed sheets at regular intervals to the adjoining wire stitching segment, the wire stitching segment includes stitching stations spaced apart from one another along the conveyor path, each stitching station including a stitching device connected for being driven in cycle with the stitching devices of the other stitching stations, the stitching segment including means for driving each stitching device at 1/n cycles of the conveyor movement of the printed products along the conveyor path, wherein n equals at least 2 and means for driving the wire stitching devices with an oscillating movement along the wire stitching segment, during a wire stitching operation, in the same direction as the transport direction for the printed products.

2. A gathering and wire stitching machine according to claim 1, wherein the number of wire stitching stations corresponds to a specific number of printed product groups and the wire stitching stations are allocated in a distributed manner to the printed products of the printed product groups.

3. A gathering and wire stitching machine according to claim 2, wherein the wire stitching devices are coordinated with successively arriving printed products as seen in an upstream direction.

4. A gathering and wire stitching machine according to claim 2, wherein each printed product occupies a space of one feed hole on the conveyor path and the wire stitching stations are arranged side-by-side on the wire stitching segment at a distance relative to one another of at least one feed hole space.

5. A gathering and wire stitching machine for producing products from folded printed sheets, comprising:

a conveyor path including a gathering segment and an adjoining wire stitching segment, the conveyor path including a saddle-shaped support for receiving printed sheets in a straddling arrangement from feeders arranged along the gathering segment, the gathering segment including continuously conveying drive devices along the support for moving the printed products in a transport direction and operating jointly and in cycle with the feeders to convey the deposited printed sheets at regular intervals to the adjoining wire stitching segment, the wire stitching segment including a first wire stitching station having a first wire stitching device, a second wire stitching station spaced apart from the first wire stitching station along the conveyor path and having a second wire stitching device connected for being driven in cycle with the first wire stitching device, and means for controlling the wire stitching operations of the wire stitching devices in phase displacement.

6. A gathering and wire stitching machine according to claim 5, further including means for driving the wire stitching devices along the wire stitching segment in counter-rotation relative to one another.

7. A gathering and wire stitching machine according to claim 5, further including a crank gear arrangement coupling the stitching devices.

8. A gathering and wire stitching machine according to claim 5, wherein the driving means comprises a connected control arrangement including at least one radial cam.

* * * * *